US007384032B2

(12) United States Patent
Sata

(10) Patent No.: US 7,384,032 B2
(45) Date of Patent: Jun. 10, 2008

(54) SHEET FEEDING APPARATUS, IMAGE READING APPARATUS, AND IMAGE FORMING APPARATUS

(75) Inventor: Junichi Sata, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 125 days.

(21) Appl. No.: 11/275,898

(22) Filed: Feb. 2, 2006

(65) Prior Publication Data

US 2006/0170147 A1 Aug. 3, 2006

(30) Foreign Application Priority Data

Feb. 3, 2005 (JP) ..... 2005-027504

(51) Int. Cl.
*B65H 7/08* (2006.01)

(52) U.S. Cl. ..... 271/110; 271/121; 271/124

(58) Field of Classification Search ..... 271/121, 271/124, 110

See application file for complete search history.

(56) References Cited

U.S. PATENT DOCUMENTS 5,370,381 A * 12/1994 Winship et al. ..... 271/121
6,318,716 B1 * 11/2001 Okuda ..... 271/121
6,331,001 B1 * 12/2001 Sekiguchi ..... 271/9.01
6,540,221 B2 * 4/2003 Nakashima et al. ..... 271/121
6,550,759 B2 * 4/2003 Kotaka et al. ..... 271/10.11
7,077,396 B2 * 7/2006 Uwagaki et al. ..... 271/121
7,100,914 B2 * 9/2006 Ramos ..... 271/121

FOREIGN PATENT DOCUMENTS

JP 9-124174 5/1997
JP 10-316265 12/1998

* cited by examiner

*Primary Examiner*—David H Bollinger
(74) *Attorney, Agent, or Firm*—Fitzpatrick, Cella, Harper & Scinto

(57) ABSTRACT

A sheet feeding apparatus includes a feeding roller and a separation pad, and the sheet feeding apparatus sequentially separates and feeds a sheet one by one in a nip portion formed by the feeding roller and the separation pad. The sheet feeding apparatus includes a pad mount and an eccentric shaft. The pad mount supports the separation pad, and is movable in a direction in which a nip area by the separation pad is changed. The eccentric shaft moves the pad mount in the direction in which the nip area is changed. The sheet feeding apparatus is characterized in that the eccentric shaft moves the pad mount in the direction in which the nip area by the separation pad is gradually narrowed in separating the sheet one by one.

11 Claims, 17 Drawing Sheets

SHEET FEEDING APPARATUS, IMAGE READING APPARATUS, AND IMAGE FORMING APPARATUS

BACKGROUND OF THE INVENTION

1. Field of the Invention

The present invention relates to a sheet feeding apparatus for feeding a sheet, an image reading apparatus, and image forming apparatus such as a copying machine, a laser-beam printer, and a facsimile machine.

2. Description of the Related Art

An example of the conventional sheet feeding apparatus used for the image forming apparatus such as the copying machine will be described with reference to FIG. 10. FIG. 10 shows a frictional pad separation type sheet feeding apparatus. The sheet feeding apparatus includes a feeding roller 151, a lifter 152, and a separation pad 153. The feeding roller 151 is rotatable in a direction of an arrow a. The lifter 152 is elevatable in directions of arrows b and c while supporting a front end side of the sheet. The separation pad 153 is pressed against a feeding surface 151*a*, which is of an outer peripheral surface of the feeding roller 151, to form the nip portion n.

The separation pad 153 is made of a rubber material such as urethane rubber and EPDM (ethylene, propylene, diene, monomer) in a plate shape. The separation pad 153 is bonded on an upper surface of a pad mount 153*b* rotatable about a shaft 153*a* and on a position where the pad mount 153*b* faces the feeding roller 151. The pad mount 153*b* is biased by a coil spring 153*c*, which presses the separation pad 153 against the feeding roller 151.

Before a sheet-shaped original S is fed, a front end portion of a bundle of plural originals S stacked on an original tray 154 is inserted between the lifter 152 and the feeding surface 151*a* of the feeding roller 151. The lifter 152 is elevated in the direction of the arrow b of FIG. 10 to sandwich the inserted front end portion of the bundle of originals S by the lifter 152 and the feeding roller 151.

When the feeding roller 151 is rotated in the direction of the arrow a of FIG. 10, an uppermost original S1 on the original tray 154 is fed in a direction of an arrow d by frictional force acting between the feeding roller 151 and the original S. When the original S passes through the nip portion n between the feeding roller 151 and the separation pad 153, the front end of the bundle of originals S is individually separated to prevent double-sheet feeding by the frictional force of the separation pad 153, and only one sheet is separated and delivered.

After the separation and feeding, the front end of the original S1 reaches a conveyance roller pair (not shown) and sandwiched by the conveyance roller pair arranged on the downstream side of the feeding roller 151 in an original feeding direction. The lifter 152 is located at the pressing position with respect to the feeding roller 151 while conveyance force is imparted, which prevents the conveyance roller pair from conveying the original S1. Therefore, the lifter 152 is previously rotated in the direction of the arrow c to lower to a retracted position.

In the sheet feeding apparatus having the above configuration, the good separation and feeding are achieved by utilizing a delicate difference in frictional force among the feeding roller 151, the separation pad 153, the original S, and the like.

However, as shown in FIG. 10, hardness of the separation pad 153 is relatively increased in the separation pad 153 having the configuration in which the rubber material is formed in a plate shape and bonded onto the upper surface of the pad mount 153*b* in a planar manner. Therefore, a region of the nip portion n formed between the feeding roller 151 and the separation pad 153 is narrow in the original feeding direction. In other words, the nip portion n has a small area. Accordingly, a friction coefficient μ of the nip portion n is remarkably decreased from the viewpoint of durability, and there is a fear that the double-sheet feeding is generated because the front end of the bundle of originals S is not sufficiently separated. On the other hand, in techniques described in Japanese Patent Application Laid-Open (JP-A) No. 9-124174 and JP-A No. 10-316265, the wide nip portion whose region in the original conveyance direction is broadened is formed in order to improve the double-sheet feeding preventing performance. However, in the techniques described in JP-A No. 9-124174 and JP-A No. 10-316265, since the nip portion is formed in the wide nip portion, vibration generated in the wide nip portion is increased while the double-sheet feeding preventing performance is improved by the wide nip portion. Therefore, the conveyance performance is decreased due to the vibration itself, and there is a fear that judder of the nip portion is generated due to the vibration.

SUMMARY OF THE INVENTION

In view of the foregoing, an object of the invention is to control the vibration, generated by the nip portion formed between the feeding rotating member and the separation pad, to a low level and to suppress the decrease in conveyance performance and the judder, caused by the vibration, while improving the double-sheet feeding preventing performance.

In order to achieve the above object, there is provided a sheet feeding apparatus which includes a feeding rotation member feeding a sheet and a separation pad pressed against said feeding rotation member to form a nip for separating the sheet one by one, the sheet feeding apparatus sequentially separating and feeding the sheet one by one in said nip, the sheet feeding apparatus comprising: a pad mount to which said separation pad is attached, the pad mount being supported while being movable in a direction in which a nipping area by said separation pad in a sheet feeding direction is changed; and moving device which moves said pad mount in the direction in which said nipping area is changed, wherein said moving device moves said pad mount such that said nipping area in the sheet feeding direction is gradually narrowed in separating the sheet.

DESCRIPTION OF THE PREFERRED EMBODIMENTS

Preferred embodiments of the invention will be described in detail below with reference to the drawings. However, dimensions, materials, shape, relative arrangements, and the like of the components described in the following embodiments should appropriately be changed according to the configurations of the apparatus and various conditions to which the invention is applied. The scope of the invention should not be limited to the embodiments as long as the specific description is given.

First Embodiment

Figure 1:
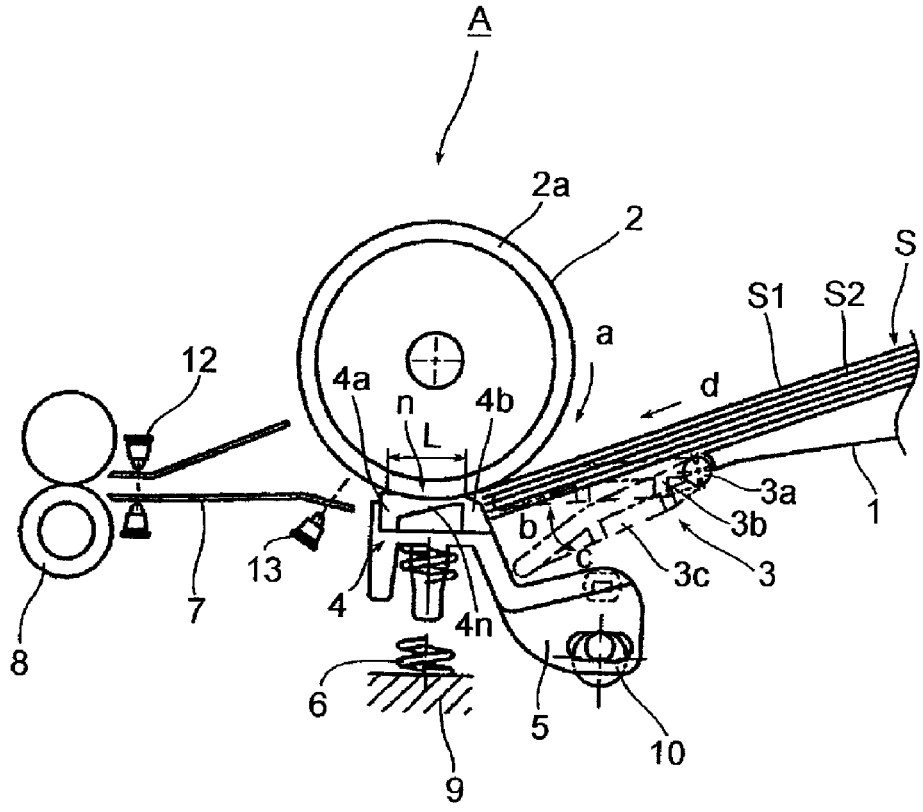
FIG. 1 is a sectional explanatory view showing a configuration of a sheet feeding apparatus according to a first embodiment of the invention.
Figure 2:
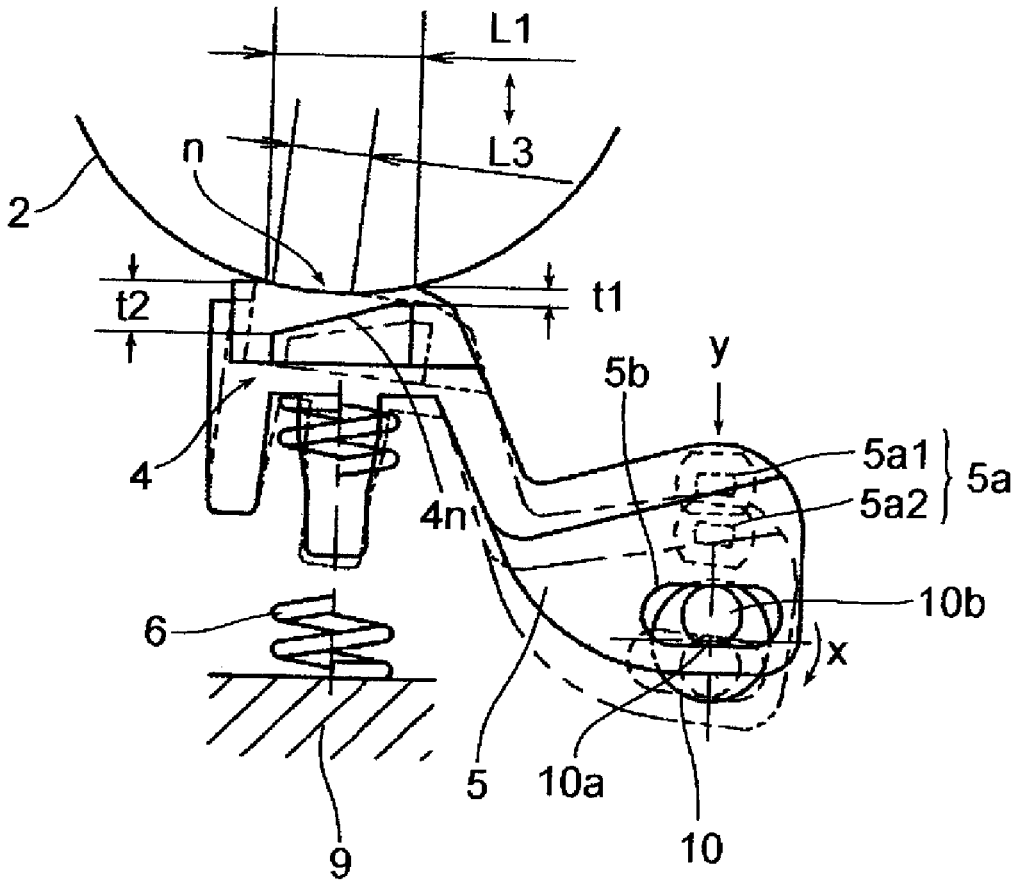
FIG. 2 is a sectional explanatory view showing a configuration of a main part of the sheet feeding apparatus according to the first embodiment of the invention.
Figure 3:
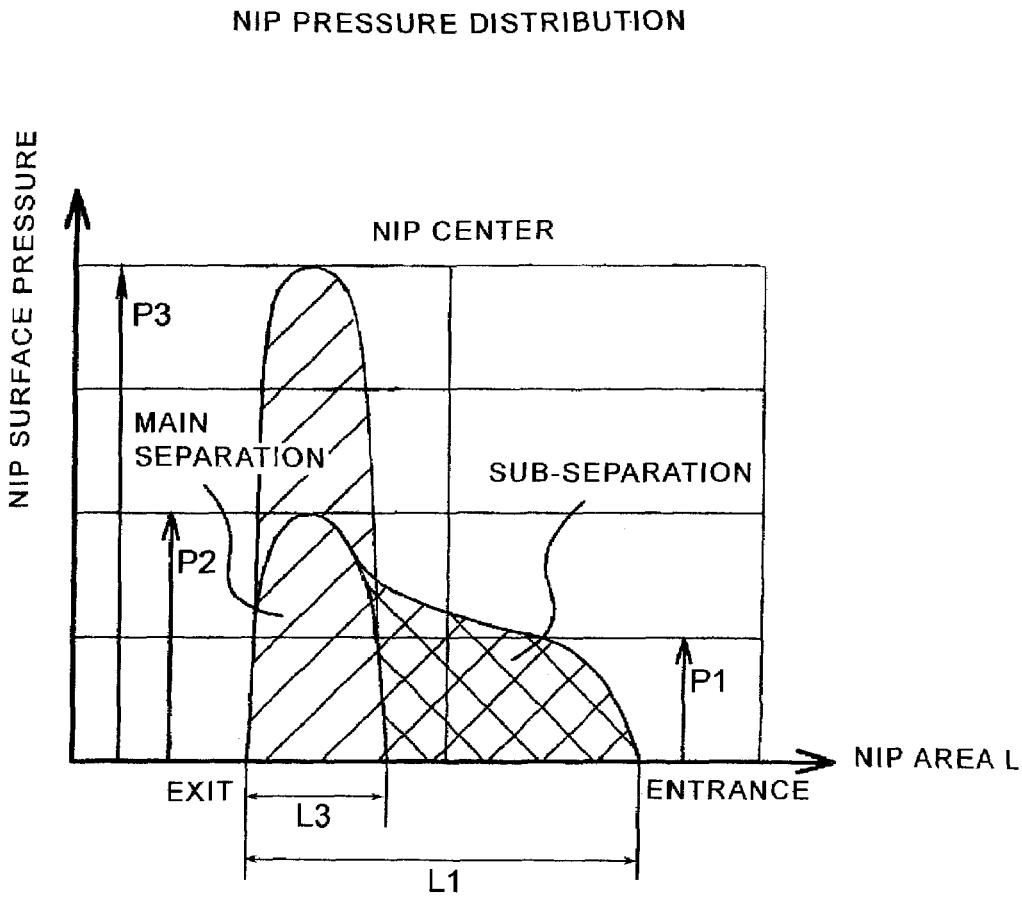
FIG. 3 is a distribution view showing a nip pressure distribution of the sheet feeding apparatus according to the first embodiment of the invention.
Figure 5:
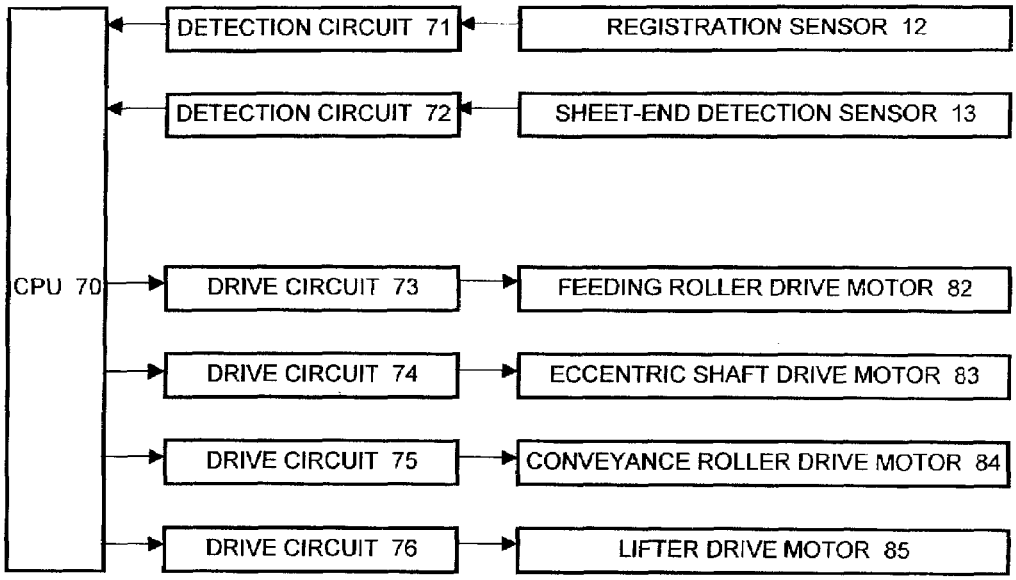
FIG. 5 is a block diagram showing a control system in the sheet feeding apparatus according to the first embodiment of the invention.
Figure 6:
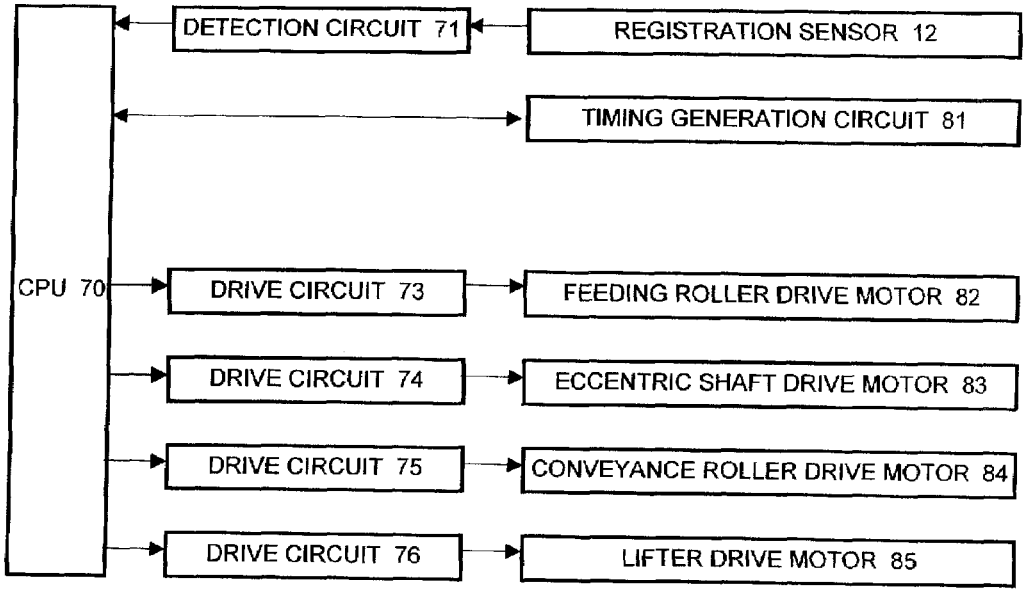
FIG. 6 is a block diagram showing another control system in the sheet feeding apparatus according to the first embodiment of the invention.
Figure 7:
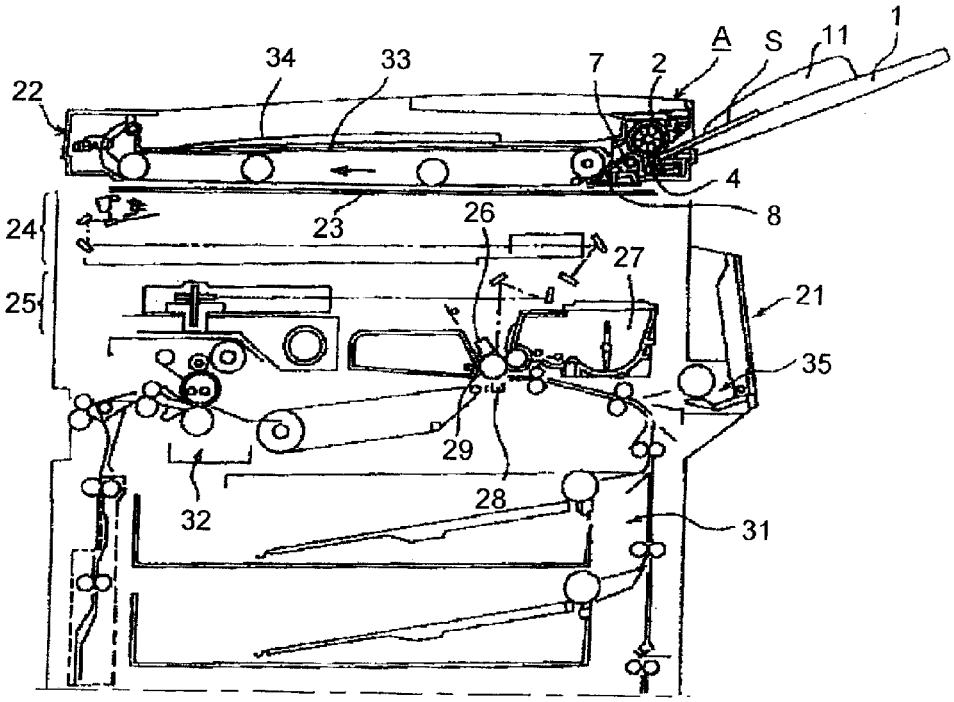
FIG. 7 is a sectional explanatory view showing a configuration of an image forming apparatus provided with the sheet feeding apparatus according to the invention.

FIG. 1 is a sectional explanatory view showing a configuration of a sheet feeding apparatus according to a first embodiment of the invention. FIG. 2 is a sectional explanatory view showing a configuration of a main part of the sheet feeding apparatus of the first embodiment. FIG. 3 is a distribution view showing a nip pressure distribution of a main part of the sheet feeding apparatus of the first embodiment. FIG. 4 is an explanatory view showing a feeding action in the first embodiment. FIG. 5 is a block diagram showing a control system in the first embodiment. FIG. 6 is a block diagram showing another control system in the first embodiment. FIG. 7 is a sectional explanatory view showing a configuration of an image forming apparatus provided with the sheet feeding apparatus according to the invention. As shown in FIG. 1, the sheet feeding apparatus according to the first embodiment of the present invention includes a stacking tray 1 which is of sheet stacking device for stacking sheet-shaped originals S. The sheet-shaped original S is the sheet to be read, and the sheet is made of paper or synthetic resin. The sheet feeding apparatus includes a feeding roller 2 which is of a feeding rotating member, and the feeding roller 2 is arranged on a downstream side of the stacking tray 1 in an original feeding direction (hereinafter simply referred to as "downstream side"). The sheet feeding apparatus includes a lifter 3 arranged between the stacking tray 1 and the feeding roller 2, and the lifter 3 presses a front end of the original S stacked on the stacking tray 1 against the feeding roller 2. The sheet feeding apparatus includes a separation pad 4 having a separation pad and the like, and the separation pad 4 is arranged on the downstream side of the lifter 3 while facing the feeding roller 2.

As shown in FIG. 1 , the stacking tray 1 is obliquely arranged with a predetermined angle and a bundle of plural originals S can be stacked on the stacking tray 1. A side-end regulation member 11 regulates a position in a direction orthogonal to the original feeding direction (direction of arrow d of FIG. 1) while the bundle of originals S is stacked on the stacking tray 1. The bundle of originals S abuts on an entrance of a nip portion n which is of a pressing portion formed between the separation pad 4 and the feeding roller 2 stopped by deadweight.

The feeding roller 2 has a rubber surface having a high friction coefficient, and the position of the feeding roller 2 is fixed with respect to the apparatus main body. The feeding roller 2 is rotated in a direction of an arrow a of FIG. 1 at predetermined timing by driving device (not shown) to feed the original S stacked on the stacking tray 1.

As shown in FIG. 1, the lifter 3 is configured to be rotatable about a rotation center 3*a* between a lifted position 3*b* and a lowered position 3*c* in directions b and c in FIG. 1 at predetermined timing. The separation pad 4 is made of a rubber material such as urethane rubber and EPDM (ethylene, propylene, diene, monomer). As shown in FIG. 1, the separation pad 4 includes a nip forming portion 4*n* and support portions 4*a* and 4*b*. The nip forming portion 4*n* faces the feeding roller 2. The support portions 4*a* and 4*b* are provided on the upstream side of the nip forming portion 4*n* in the sheet feeding direction (hereinafter simply referred to as "upstream side") and the downstream side respectively, and the support portions 4*a* and 4*b* support the nip forming portion 4*n* in a bridge-shape manner. The separation pad 4 is supported in the bridge-shape manner while standing on a pad mount 5 by the support portions 4*a* and 4*b* provided on the upstream side and the downstream side of the nip forming portion 4*n*. The pad mount 5 is made of a hard material such as resin and metal.

As shown in FIG. 2, the pad mount 5 is configured to be rotatable about a rotation center 5*a*. In the pad mount 5, a free-end side supporting the separation pad 4 is always pressed toward the direction of the feeding roller 2 with predetermined pressing force by a coil spring 6. The coil spring 6 is of pressing unit whose free-end side supporting the separation pad 4 is supported by an apparatus main body frame 9. The rotation center 5*a* is supported while being movable only in the vertical direction. The pad mount 5 is configured to be movable in the direction in which the area (hereinafter referred to as nip area) is changed in the sheet feeding direction of the nip portion n by the separation pad 4. Specifically, as shown in FIG. 2, in the pad mount 5, an eccentric portion 10*b* of an eccentric shaft 10 is fitted in a fitting hole 5*b*. The eccentric shaft 10 is rotatable about an eccentric shaft center 10*a*. The eccentric shaft 10 is moving device which moves the rotation center 5*a* of the pad mount 5 in a predetermined direction, and the eccentric shaft 10 is rotated in a direction of arrow x of FIG. 2 about the eccentric shaft center 10*a* at predetermined timing by rotation device (not shown). That is, in the pad mount 5, the position of the rotation center 5*a* is movable in a direction of an arrow y of FIG. 2 by the rotation of the eccentric shaft 10. Accordingly, an attitude of the pad mount 5 is changed by the rotation of the eccentric shaft 10 to change the nip area of the nip forming portion 4*n* of the separation pad 4.

On the other hand, as described above, the separation pad 4 has the support portions 4*a* and 4*b* and the nip forming portion 4*n*. The support portions 4*a* and 4*b* are fixed in the bridge shape and bonded to the pad mount 5, and the nip forming portion 4*n* is separated from the pad mount 5. A thickness t of the nip forming portion 4*n* is gradually increased from the upstream side to the downstream side in the original feeding direction.

As shown in FIG. 2, a thickness t1 on the upstream side (entrance side) of the nip forming portion 4*n* is formed thinner than a thickness t2 on the downstream side (exit side) (t1<t2). Therefore, when a nip area L formed by the nip forming portion 4*n* is L1 shown in FIG. 3, separation surface pressure P1 near the entrance is set smaller than separation surface pressure P2 by a difference in apparent elasticity of the separation pad 4. The eccentric shaft 10 is rotated to move the rotation center 5*a* of the pad mount 5, which allows the nip area L to be changed from L1 (solid-line position of FIG. 2) to L3 (alternate long and two short dashes line position of FIG. 2).

FIG. 3 shows a separation pressure distribution of the separation pad 4 in the above configuration. When the separation surface pressure in which the nip area L of the separation pad 4 is the widest L1 and the separation surface pressure in which the nip area L of the separation pad 4 is the narrowest L1 will be described.

As shown in FIG. 2, when the rotation center 5*a* of the pad mount 5 is located at a position 5*a*1, the variable nip area L is the widest nip area L1. As shown in FIG. 3, in the separation surface pressure of the nip area L1, the separation surface pressure P1 of the entrance-side portion is lower than the separation surface pressure P2 of the exit-side portion.

At this point, in the case where the rotation center 5*a* of the pad mount 5 is located at the position 5*a*1, it is assumed that the two or more originals S enter the entrance-side portion (sub-separation) of the nip area L1 by the separation pad 4. In this case, since the separation surface pressure P1 of the entrance-side portion of the nip area L1 is set at the lower value, the originals S subsequent to the first original are easy to enter the entrance-side portion. However, the variable nip area L becomes the widest nip area L1, and the entrance-side portion is also relatively wide in the original feeding direction, so that the obstruction power stopping the entrance of the first original S1 is improved, and the performance for separating and feeding only first original S1 is improved.

The exit-side portion (main separation) of the nip area L1 has the separation surface pressure P2 higher than the separation surface pressure P1 of the entrance-side portion. Therefore, even if the original S which is relatively difficult to separate due to the high friction coefficient μ is incompletely separated in the entrance-side portion of the nip area L1, the separation can securely be performed by the exit-side portion having the higher separation surface pressure P2 to prevent the double-sheet feeding. This enables the separation performance to be improved.

On the other hand, as shown in FIG. 2, when the rotation center 5*a* of the pad mount 5 is located at a position 5*a*2, the variable nip area L is changed to the narrowest nip area L3 (L1>L2>L3). In the separation surface pressure of a nip area L3, the pressing force generated by the coil spring 6 is received by a width of the nip area L3 which has been narrowed as described above. Therefore, as shown in FIG. 3, the separation surface pressure is changed to separation surface pressure P3 which is largely higher than the separation surface pressure P2 (P1<P2<P3). When the pad mount 5 is moved, that is, the separation surface pressure P of the nip area L by the separation pad 4 is gradually increased (P1, P2→P3) in association with the movement of the nip area L by the separation pad 4 toward the direction in which the nip area L by the separation pad 4 is gradually narrowed (L1→L3). Accordingly, while the separation state of the original S is securely maintained after the separation, the troubles such as the vibration and the judder easily generated in the state of the wide nip area L1 can be suppressed.

As shown in FIG. 1, a guide 7 which guides the original S passing through the nip portion n is provided on the downstream side of the feeding roller 2, and a conveyance roller pair 8 which is of sheet conveyance device is arranged on the downstream side. A registration sensor 12 which can detect the sheet end of the original S is provided in the guide 7. A sheet-end detection sensor 13 which is of sheet-end detection device being able to detect the sheet end of the original S is provided near the downstream of the separation pad 4.

In the first embodiment, based on detection information of the sheet-end detection sensor 13, the later-mentioned control means controls an action of the eccentric shaft 10 to move the pad mount 5 in the direction in which the nip area L by the separation pad 4 is gradually narrowed.

When the pad mount 5 is moved, the separation surface pressure P of the nip area L by the separation pad 4 is also changed in association with the movement of the nip area L by the separation pad 4 toward the direction in which the nip area L by the separation pad 4 is gradually narrowed.

The feeding action of the original S performed by the sheet feeding apparatus will be described in detail with reference to FIG. 4.

(a) As shown in FIG. 1, in feeding the original S from the bundle of plural originals S stacked on the stacking tray 1, the front end portion of the bundle of originals S is inserted into the entrance of the nip portion n between the feeding roller 2 and the separation pad 4. Then, while the feeding roller 2 is rotated in the direction of the arrow a at the predetermined timing, the lifter 3 is elevated at the predetermined timing, which allows the uppermost original S1 of the bundle of originals S to abut on the feeding roller 2 to feed the uppermost original S1 in the direction of the arrow d.

At this point, in the pad mount 5, the rotation center 5*a* is maintained at the position 5*a* 1 (see FIG. 2) by the eccentric shaft 10, and the wide nip area L1 (see FIG. 4A) is formed in the nip area L. When the nip area L is the nip area L1, as described above, the separation surface pressure is set low in the entrance-side portion and is set high in the exit-side portion, so that the separation is securely performed to convey only the uppermost original S1 to the downstream.

Figure 4A:
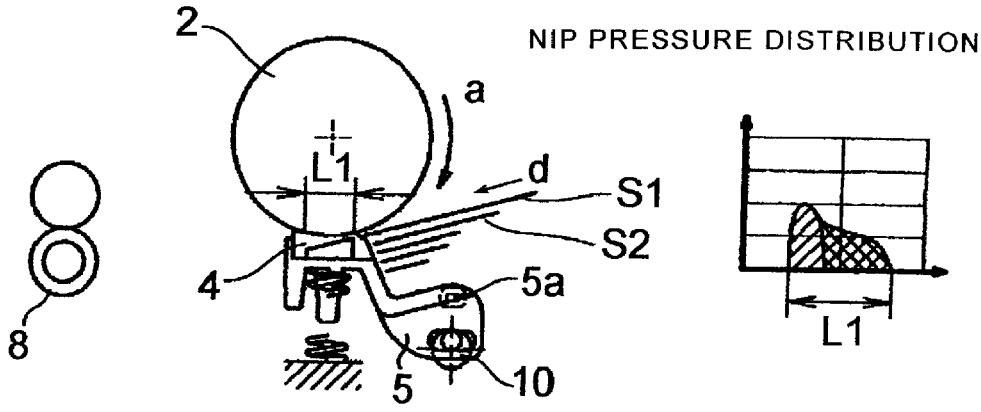
FIG. 4A to 4D is an explanatory view showing a feeding action of the sheet feeding apparatus according to the first embodiment of the invention.
Figure 4B:
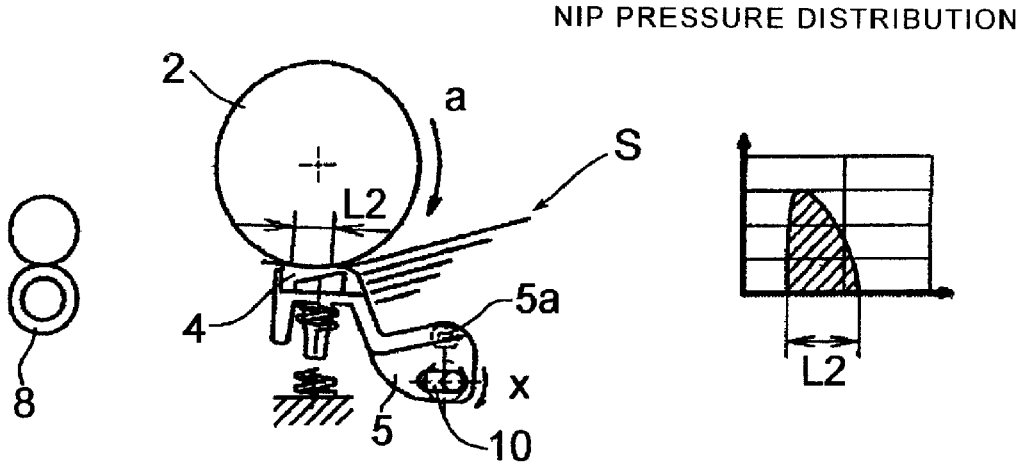
Figure 4C:
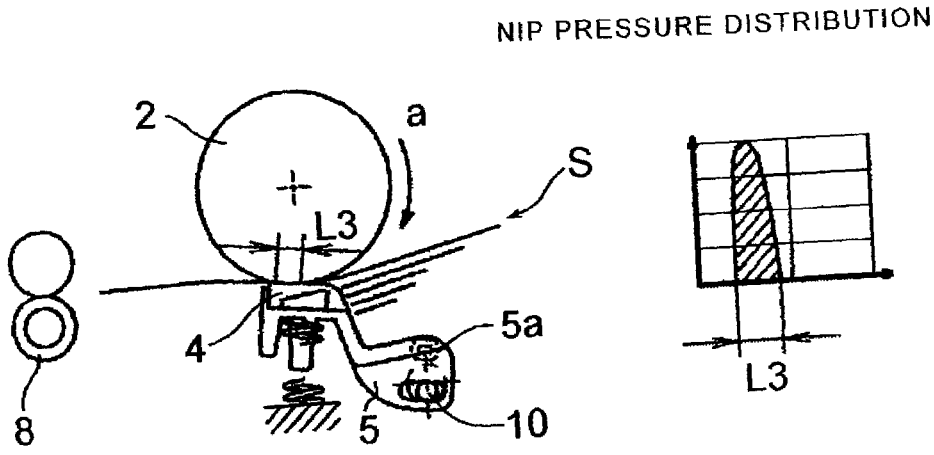
Figure 4D:
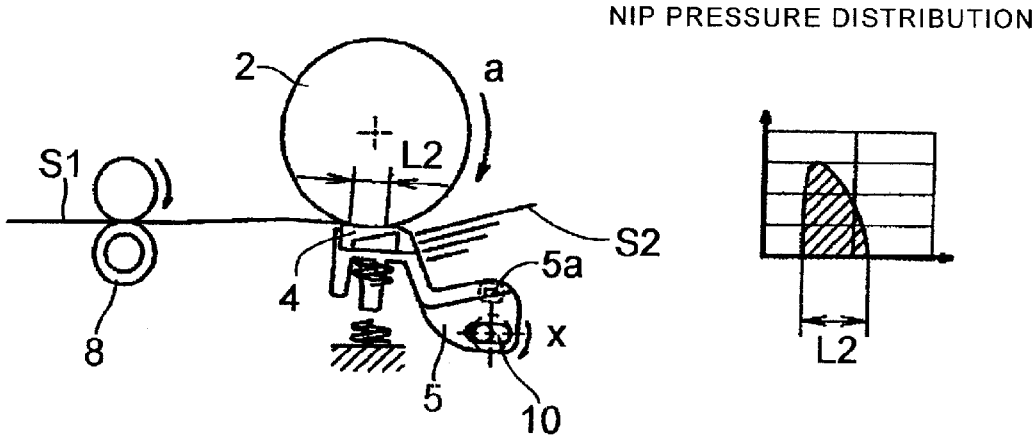

(b) After the feeding roller 2 is rotated, the eccentric shaft 10 is rotated in the direction of the arrow x of FIG. 4B at the timing in which the front end of the original S is detected by the sheet-end detection sensor 13. At this point, the nip area L of the separation pad 4 is gradually narrowed from the wide nip area L1 (nip area L2 of FIG. 4B), and the separation surface pressure is gradually increased.

In the configuration of the first embodiment, the nip area L is changed based on the detection signal of the sheet-end detection sensor 13 by using the sheet-end detection sensor 13 which detects the end portion of the original S. However, the invention is not limited to the first embodiment, for example, it is also possible to adopt the configuration in which timing generation means for generating the predetermined timing based on driving timing of the feeding roller 2 is used. In this case, the action of the eccentric shaft 10 is controlled based on the signal from the timing generation means to move the pad mount 5 in the direction in which the nip area L by the separation pad 4 is gradually narrowed. That is, when rotation control is performed to the eccentric shaft 10 at the predetermined timing in which a predetermined time elapses from the timing of the rotary drive start of the feeding roller 2, it is not necessary to use the sheet-end detection sensor, so that the sheet feeding apparatus has preferably the low-cost configuration.

(c) The feeding roller 2 is continuously rotated, and the eccentric shaft 10 is rotated by a predetermined angle and stopped. The rotation center 5*a* of the pad mount 5 is maintained at the position 5*a*2 (see FIG. 2) by the stop of the rotation of the eccentric shaft 10 after rotated by the predetermined angle. At this point, the narrow nip area L3 is formed in the nip area L of the separation pad 4. When the nip area L3 is formed in the nip area L, since the separation surface pressure is set higher, the uppermost original S1 is conveyed while the separation state is securely maintained, and the uppermost original S1 is delivered to the conveyance roller pair 8 on the downstream side.

The vibration generated in the conveyance can be suppressed at the lower level because the nip area L3 is narrow, and the decrease in conveyance performance and the generation of the judder caused by the vibration can also be suppressed.

(d) The front end of the original S1 is detected by the registration sensor 12, and the attitude of the front end of the original S1 is corrected by the nip of the conveyance roller pair 8 based on the detection signal. Then, the conveyance roller pair 8 is rotated to convey the original S1 while sandwiching the original S1. When the conveyance roller pair 8 is driven, the rotation of the feeding roller 2 is stopped, and the feeding roller 2 is driven and rotated by the original S1 conveyed by the conveyance roller pair 8. After the conveyance is continued and the rear end of the original S1 enters the nip area L3, the eccentric shaft 10 is rotated again in the direction of the arrow x of FIG. 4D at the predetermined timing. It is preferable that the predetermined timing be immediately after the rear end of the original S1 enters the nip area of the separation pad 4.

At this point, the nip area L of the separation pad 4 is gradually widened from the narrow nip area L3 (nip area L2 of FIG. 4D), and the separation surface pressure is gradually decreased. Finally the separation surface pressure is returned to the state of the feeding action start shown in FIG. 4A. That is, the eccentric shaft 10 is rotated by the predetermined angle and stopped, and the rotation center 5*a* of the pad mount 5 is maintained at the position 5*a*1 (see FIG. 2) by stopping the rotation of the eccentric shaft 10. For the originals S subsequent to the uppermost original, the above series of actions shown in FIG. 4 is repeated. According to the first embodiment, the above series of the feeding actions shown in FIG. 4 is repeated in separating and feeding each one original S.

Thus, according to the first embodiment, the rotation center 5*a* of the pad mount 5 is moved by the rotation of the eccentric shaft 10, which changes the nip area L by the separation pad 4 supported by the pad mount 5. Therefore, the wide nip area L1 can be formed in the nip area L between the feeding roller 2 and the separation pad 4 to further improve the double-sheet feeding preventing performance of the original S. In separating the originals one by one, the vibration generated in the nip area can be suppressed at lower level by gradually narrowing the nip area L, and the decrease in conveyance performance and the generation of the judder caused by the vibration can also be suppressed.

A control system in the first embodiment will be described with reference to FIG. 5. FIG. 5 is a block diagram showing the control system in the first embodiment. Referring to FIG. 5, the numeral 70 designates CPU which is of control means, and CPU 70 controls the action of each of the later-mentioned component. A registration sensor 21 and a sheet-end detection sensor 12 are connected to CPU 70 through detection circuits 71 and 72 respectively.

CPU 70 transmits signals to a feeding roller drive motor 82 and an eccentric shaft drive motor 83 through drive circuits 73 and 74 respectively. The feeding roller drive motor 82 drives the feeding roller 2, and the eccentric shaft drive motor 83 drives the eccentric shaft 10. CPU 70 also transmits signals to a conveyance roller drive motor 84 and a lifter drive solenoid 85 through drive circuits 75 and 76. The conveyance roller drive motor 84 drives the conveyance roller 8, and the lifter drive solenoid 85 drives the lifter 3. CPU 70 controls the drive of each of the motors and the solenoid.

In stead of the sheet-end detection sensor, a timing generation circuit 81 is used in the configuration shown in FIG. 6 as another configuration of the control system, and the timing generation circuit 81 is of timing generation means for generating the predetermined timing based on the drive timing of the feeding roller 2. FIG. 6 is a block diagram showing another configuration of the control system. The block diagram shown in FIG. 6 differs from the block diagram shown in FIG. 5 equipped with the sheet-end detection sensor 13 and the detection circuit 72 in that the timing generation circuit 81 which is of the timing generation means is synchronized with the drive timing of the sheet feeding device.

In the control system shown in FIG. 6, instead of the sheet-end detection sensor 13, the timing generation circuit 81 which generates the predetermined timing based on the feeding roller drive timing generated by CPU 70 can be used to control the timing at which the eccentric shaft 10 is rotated. Accordingly, the sheet feeding apparatus has preferably the low-cost configuration with no use of the sheet-end detection sensor 13.

Then, a configuration of an image forming apparatus provided with the sheet feeding apparatus of the first embodiment will be described with reference to FIG. 7. In the first embodiment, the copying machine is illustrated as the image forming apparatus, and a mode in which the invention is applied to the sheet feeding apparatus for feeding the sheet to be read toward the image reading device in the copying machine is illustrated. FIG. 7 is a sectional view schematically showing a part of the copying machine provided with the sheet feeding apparatus according to the first embodiment. In FIG. 7, the sheet feeding apparatus of the first embodiment is configured as an automatic original feeding apparatus 22 attached to the upper portion of an image forming apparatus main body 21.

As shown in FIG. 7, an image reading apparatus having an image reading device 24 is provided in the upper portion of the image forming apparatus main body 21. The image reading device 24 is of image reading device which reads image information on the original S which is placed on a platen glass 23 or conveyed on a platen glass 23.

An image forming device 30 is provided in the lower portion of the image reading device 24. The image forming device 30 is of image recording device which forms the image according to the image information read by the image reading device 24. The image forming device 30 forms a toner image on a recording sheet which is of the sheet to be recorded, and is made of paper or synthetic resin by an exposure unit 25, a charger 26, a development unit 27, a transfer unit 28, and an electrophotographic photosensitive drum 29 and the like. A feeding conveyance device 31, a fixing device 32, and the like are also arranged in the image forming apparatus. The feeding conveyance device 31 feeds the recording sheet to the image forming device 30 while conveys the recording sheet after the toner image is formed.

The fixing device 32 performs heating and pressing process to the unfixed toner image on the recording sheet to establish the permanent fixation.

The automatic original feeding apparatus 22 is arranged on the platen glass 23. The automatic original feeding apparatus 22 includes the sheet feeding apparatus A, a conveyance belt 33, and a discharge tray 34 and the like. The conveyance belt 33 is tensioned by a drive roller, a driven roller, and a tension roller, and the conveyance belt 33 is rotated so as to convey the original S fed by the sheet feeding apparatus A toward the direction of the arrow e of FIG. 7.

The original S which is separated and fed by the sheet feeding apparatus A is guided to the guide 7, the original S is conveyed onto the platen glass 23 by the conveyance roller pair 8, and the original S is set at a predetermined read position on the platen glass 23 by the conveyance belt 33. After the image information on the original S is read by the image reading device 24, the original S is conveyed again and discharged onto a discharge tray 34 by the conveyance belt 33.

In the above configuration, when copy of the original S is made by setting the original S on the platen glass 23 one by one, the original S is set on the platen glass 23 by opening and closing the automatic original feeding apparatus 22 with respect to the image forming apparatus main body 21 in each case.

The sheet feeding apparatus A of the first embodiment can also be applied to a sheet feeding apparatus 35 which feeds the recording sheet placed on an openable manual-sheet-feeding tray 21 toward the image forming device 30.

Second Embodiment

Figure 8:
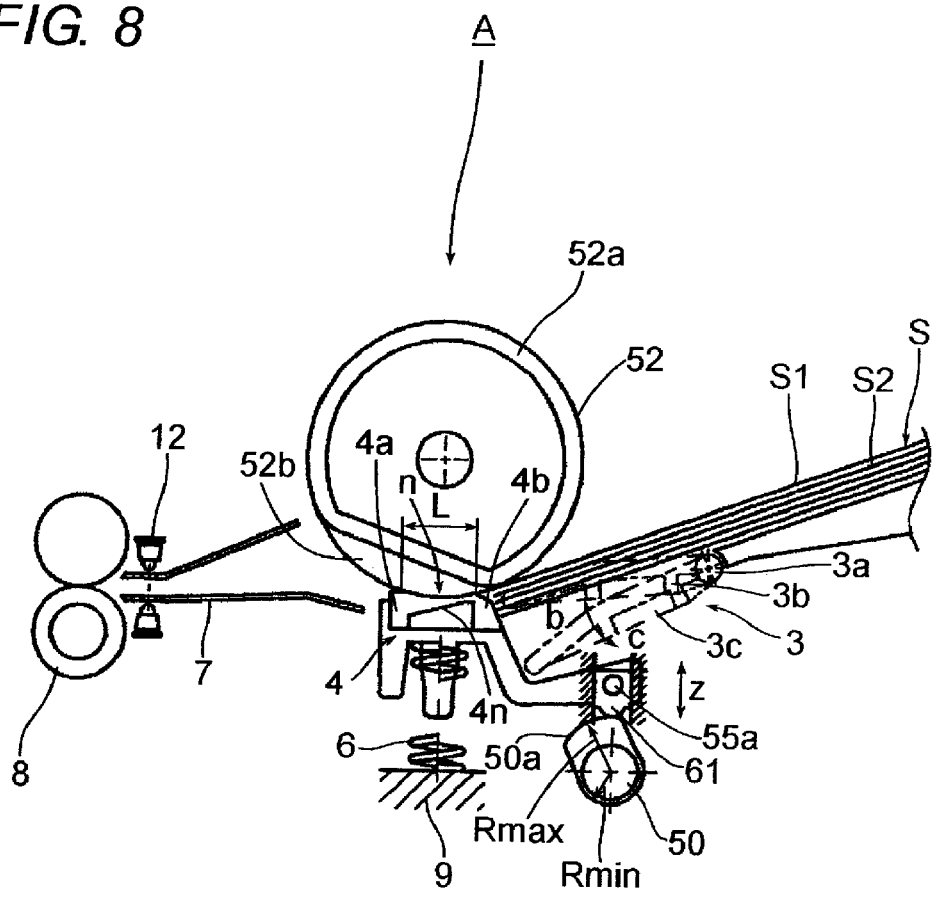
FIG. 8 is a sectional explanatory view showing a configuration of a sheet feeding apparatus according to a second embodiment of the invention.

A sheet feeding apparatus according to a second embodiment will be described with reference to FIGS. 8 and 9. FIG. 8 is a sectional explanatory view showing a configuration of the sheet feeding apparatus according to the second embodiment of the invention, and FIG. 9 is an explanatory view showing a feeding action in the second embodiment. In FIGS. 8 and 9, the same configuration as the first embodiment is designated by the same numeral, and components (not shown) have the same configurations as the first embodiment described above, so that the explanation will not be described.

As shown in FIG. 8, in the sheet feeding apparatus of the second embodiment, a feeding roller 52 which is of a feeding rotating member is configured by a D-shaped cut roller which has a rubber surface 52*a* and a collar portion 52*b* according to the rotation angle. The rubber surface 52*a* has the high friction coefficient, and the collar portion 52*b* has the low friction coefficient. The D-shaped cut roller is in a standby state at the angle shown in FIG. 8, and can perform a cycle of separation and feeding action to the one original S by one rotation.

On the other hand, as shown in FIG. 8, a pad mount 55 of the second embodiment is configured to be rotatable about a rotation center 55*a* through a slider 61. The pad mount 55 is always pressed toward the direction of a feeding roller 52 with the predetermined pressing force by the coil spring 6. The coil spring 6 is of pressing device whose free-end side supporting the separation pad 4 is supported by the apparatus main body frame 9.

The slider 61 rotatably supports the rotation center 55*a* of the pad mount 55. The slider 61 is slidably moved in a direction of an arrow z of FIG. 8 along a groove supported by the apparatus main body frame 9. A rotating cam 50 is of moving device which moves the slider 61 in the direction of the arrow z, and the rotating cam 50 is rotated by rotation device (not shown). The slider 61 is biased to a cam surface 50*a* of the rotating cam 50. Similarly to the first embodiment, in the pad mount 55 of the second embodiment, the position of the rotation center 55*a* is movable in the direction of the arrow z of FIG. 8 by the rotation of the rotating cam 50. Accordingly, the attitude of the pad mount 55 is changed by the rotation of the rotating cam 50, which change the nip area of the nip forming portion in the separation pad 4.

In the sheet feeding apparatus of the second embodiment, the feeding roller 52 and the rotating cam 50 are configured to be driven by the same drive source (not shown). In the second embodiment, a gear train is configured from the feeding roller 52 to the rotating cam 50 while a gear ratio is set at 1:1, which allows the desired rotation angle of the rotating cam 50 to be set according to the feeding action of the feeding roller 52.

Then, the feeding action of the sheet feeding apparatus of the second embodiment will be described in detail with reference to FIGS. 9A to 9E.

Figure 9A:
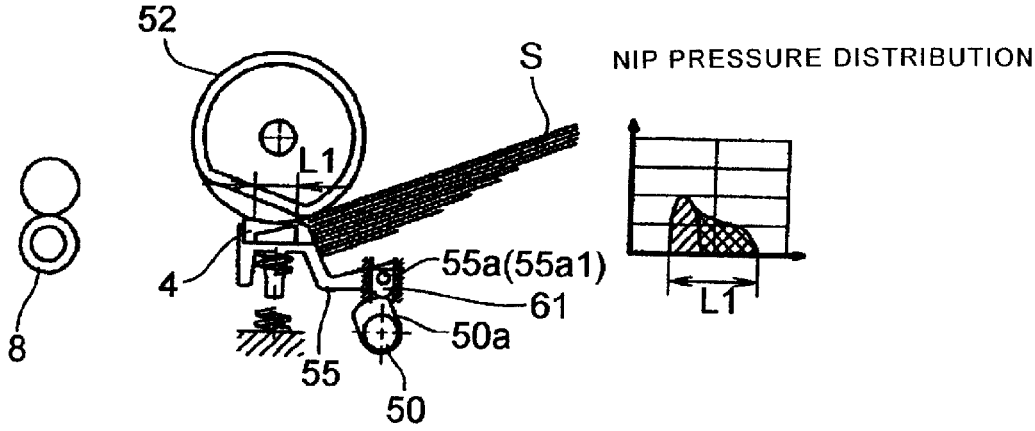
FIG. 9A to 9E is an explanatory view showing a feeding action of the sheet feeding apparatus according to the second embodiment of the invention.
Figure 9B:
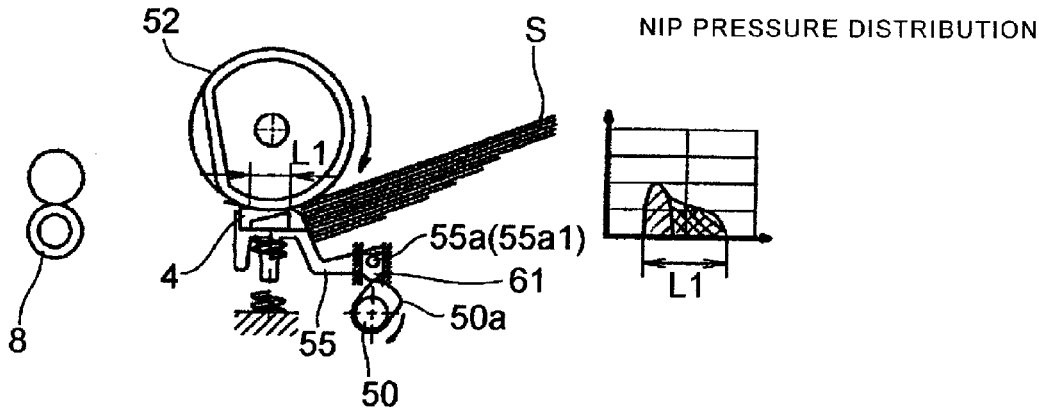
Figure 9C:
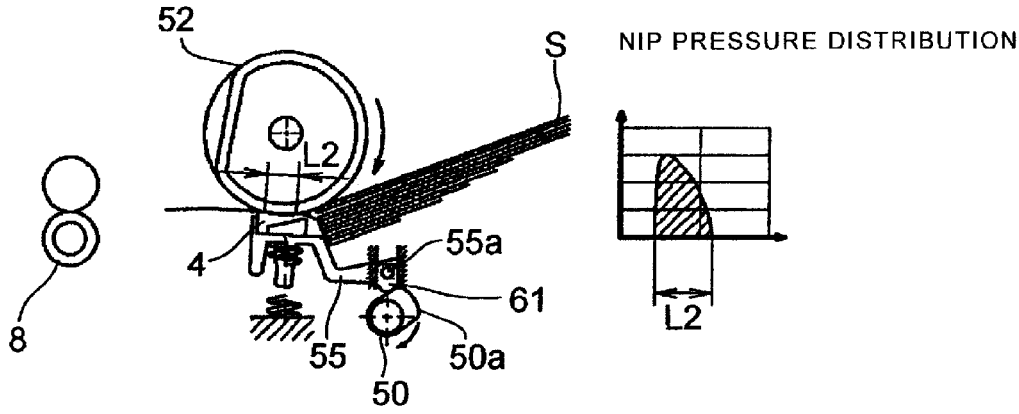
Figure 9D:
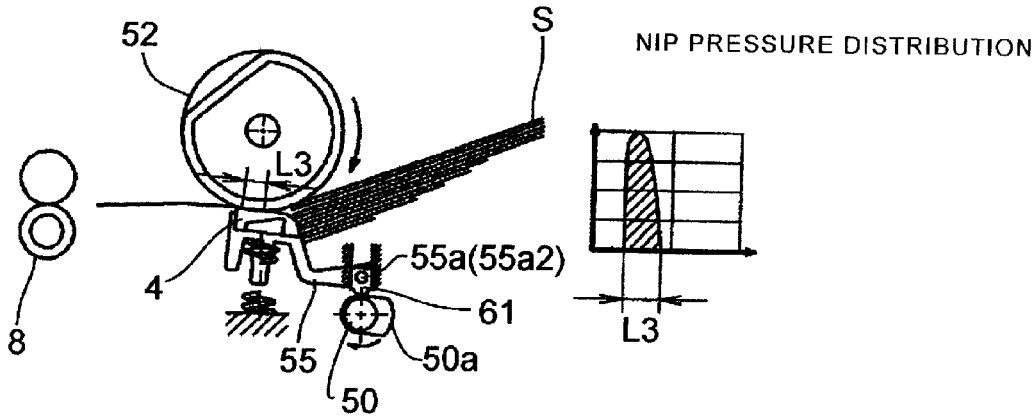
Figure 9E:
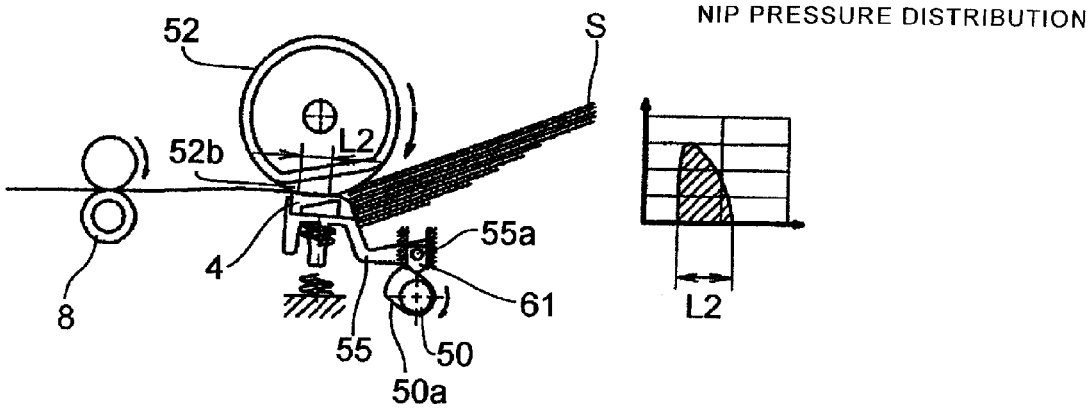
Figure 10:
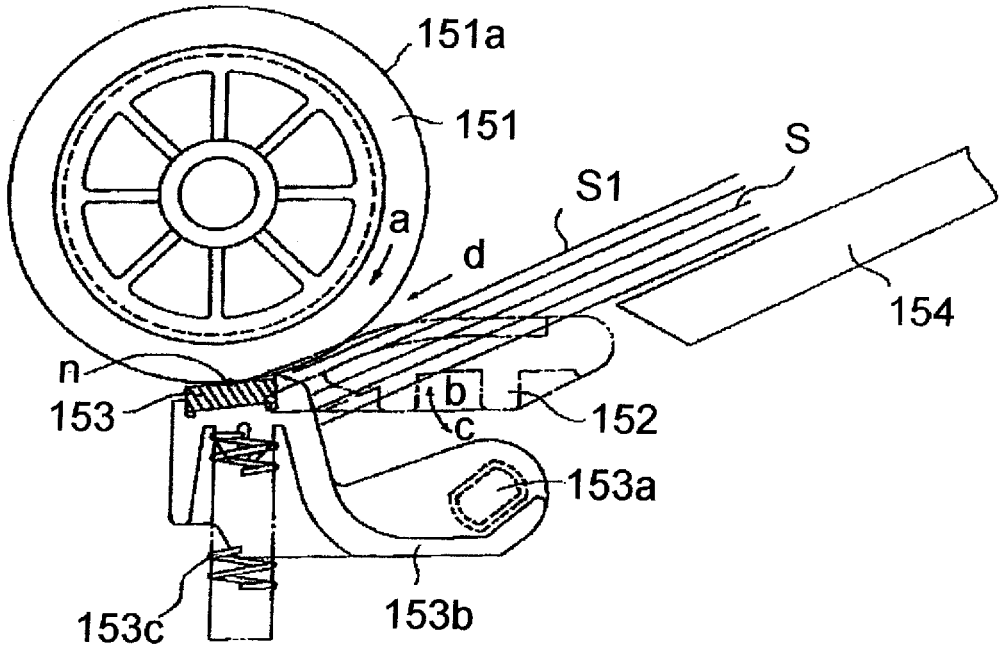
FIG. 10 is a view explaining a conventional example.

(a) In feeding the original S from the bundle of plural originals S stacked on the stacking tray 1, the feeding roller 52 is set at the rotation angle position shown in FIG. 9A. At this point, the rotation center 55*a* of the pad mount 55 is maintained at a position 55*a*1 by a radius Rmax of the cam surface 50*a* of the rotating cam 50, and the wide nip area L1 is formed in the nip area L.

(b) When the rotation action of the feeding roller 52 is started in the direction of the arrow a, the lifter 3 is elevated at the predetermined timing, and the front end portion of the bundle of originals S into the entrance of the nip portion n between the feeding roller 2 and the separation pad 4. The uppermost original of the inserted bundle of originals S abuts on a rubber surface 52*a* of the feeding roller 52, and the uppermost original is fed.

At this point, the rotating cam 50 is rotated in the direction of the arrow x in synchronization with the feeding roller 52, the rotation center 55*a* of the pad mount 5 is maintained at the position 55*a*1 by the radius Rmax of the cam surface 50*a* of the rotating cam 50, and the wide nip area L1 is maintained in the nip area L. When the wide nip area L1 is maintained in the nip area L, similarly to the first embodiment, the separation surface pressure is set low in the entrance-side portion, and the separation surface pressure is set high in the exit-side portion, so that the separation is securely performed to convey only the uppermost original S1 to the downstream (c) After the feeding roller 52 is rotated, the radius of the cam surface 50*a* of the rotating cam 50, rotated in synchronization with the rotation of the feeding roller 52, is changed from Rmax to Rmin.

At this point, the nip area L of the separation pad 4 is gradually narrowed from the wide nip area L1 (nip area L2 of FIG. 9C), and the separation surface pressure is also gradually increased.

(d) When the radius of the cam surface 50*a* of the rotating cam 50 is changed to Rmin after the feeding roller 52 is further rotated, the rotation center 55*a* of the pad mount 55 is maintained at a position 55*a*2. At this point, the narrow nip area L3 is formed in the nip area L of the separation pad 4. When the nip area L3 is formed in the nip area L, since the separation surface pressure is set further higher, the uppermost original S1 is conveyed while the separation state is securely maintained, and the uppermost original S1 is delivered to the conveyance roller pair 8 on the downstream side.

The vibration generated in the conveyance can be suppressed at the lower level because the nip area L3 is narrow, and the decrease in conveyance performance and the generation of the judder caused by the vibration can also be suppressed.

(e) The front end of the original S1 is detected by the registration sensor 12, and the attitude of the front end of the original S1 is corrected by the nip of the conveyance roller pair 8 based on the detection signal. Then, the conveyance roller pair 8 is rotated to convey the original S1 while sandwiching the original S1. During sandwiching the original S1, the feeding roller 52 is continuously rotated, and the radius of the cam surface 50*a* is changed from Rmin to Rmax while the rotating cam 50 is also rotated in synchronization with the rotation of the feeding roller 52.

At this point, the nip area L of the separation pad 4 is gradually widened from the narrow nip area L3 (nip area L2 of FIG. 9E), and the separation surface pressure is gradually decreased. Finally, the feeding roller 52 is returned to the state shown in FIG. 9A after one turn, and the rotating cam 50 which is rotated in synchronization with the feeding roller 52 is also returned to the state shown in FIG. 9A.

As described above, the feeding roller 52 of the second embodiment is rotated only one turn per separation and feeding of one original S. Therefore, the rotating cam 50 which is rotated in synchronization with the feeding roller 52 is also rotated only one turn per separation and feeding of one original S in conjunction with the feeding roller 52. The original located between the separation pad 4 and the feeding roller 52 which is stopped after one turn is conveyed by the conveyance roller pair 8 on the downstream side. At this point, because the original is in contact with the low-coefficient collar portion 52*a* of the feeding roller 52, the conveyance of the uppermost original S1 by the conveyance roller pair 8 on the downstream side is not prevented even if the uppermost original S1 is located between the feeding roller 52 and the separation pad 4. For the originals S subsequent to the original, the above series of actions shown in FIG. 9 is repeated. According to the second embodiment, the above series of the feeding actions shown in FIG. 9 is repeated in separating and feeding each one original.

As described above, according to the second embodiment, the rotation center 55*a* of the pad mount 55 is moved by the rotation of the rotating cam 50, which allows the nip area L by the separation pad 4 supported by the pad mount 55 to be changed. Therefore, the wide nip area L1 can be formed in the nip area L between the feeding roller 52 and the separation pad 4 to further improve the double-sheet feeding preventing performance of the original S. In separating the originals S one by one, the nip area L can be gradually narrowed to suppress the vibration generated in the nip area at lower level, so that the decrease in conveyance performance and the generation of the judder caused by the vibration can be suppressed.

According to the second embodiment, the drive source for driving the feeding roller 52 is also used as the drive source for driving the rotating cam 50. That is, the feeding roller 52 and the rotating cam 50 are driven by the same drive sources. Therefore, in addition to the effect of first embodiment, the sheet feeding apparatus having the low-cost configuration can be provided.

Other Embodiments

Although the sheet feeding apparatus which feeds the sheet to be read such as the sheet-shaped original to the image reading device is illustrated in the above embodiment, the invention is not limited to this. For example, the same effect can be obtained even if the invention is applied to the sheet feeding apparatus which feeds the sheet to be read such as the recording sheet to the image recording device.

In the above embodiment, although the sheet feeding apparatus is illustrated in the automatic original feeding apparatus which can be attached to the image forming apparatus as an option, the invention is not limited to this. For example, the sheet feeding apparatus may be integrally provided in the image forming apparatus, and the same effect can be obtained by applying the invention to the sheet feeding apparatus.

Although the copying machine is illustrated as the image forming apparatus in the above embodiment, the invention is not limited to this. For example, the invention may be applied to other pieces of image forming apparatus such as a scanner, a printer, a facsimile machine, and a complex machine in which the functions of the scanner, the printer, and the facsimile machine are combined. The same effect can be obtained by applying the invention to the sheet feeding apparatus used in these pieces of image forming apparatus.

Although the electrophotographic type is illustrated as the recording method in the above embodiment, the invention is not limited to this. For example, other recording methods such as an inkjet type may be used.

This application claims the benefit of priority from the prior Japanese Patent Application No. 2005-027504 filed on Feb. 3, 2005 the entire contents of which are incorporated by reference herein.

What is claimed is:

1. A sheet feeding apparatus which includes a feeding rotation member for feeding a sheet and a separation pad pressed against said feeding rotation member to form a nip for separating the sheet one by one, said sheet feeding apparatus sequentially feeding the sheet separated one by one in said nip, said sheet feeding apparatus comprising:

a pad mount to which said separation pad is mounted, said pad mount being movably supported so that a nipping area of the nip in a sheet feeding direction is changed;

a moving device which moves said pad mount to change the nipping area of the nip; and a driving device which drives said moving device;

wherein said moving device driven by a driving force of said driving device moves said pad mount such that the nipping area in the sheet feeding direction is gradually narrowed in a state of nipping the sheet between the feeding rotation member and the separation pad while the sheet is separated in the nip.

2. The sheet feeding apparatus according to claim 1, wherein said pad mount is provided so as to be rotatable about a rotation center, and said moving device includes a slider which supports said rotation center while said rotation center is slidable in a predetermined direction and a cam which moves the slider.

3. The sheet feeding apparatus according to claim 1, comprising sheet-end detection device which detects the sheet separated by said separation pad on a downstream side of said nip, wherein said moving device moves said pad mount to gradually narrow said nipping area in the sheet feeding direction based on detection information of the sheet-end detection device.

4. The sheet feeding apparatus according to claim 1, comprising timing generation means which performs timing generation based on drive timing of said feeding rotation member, wherein said moving device moves said pad mount to gradually narrow said nipping area in the sheet feeding direction based on a signal from the timing generation means.

5. The sheet feeding apparatus according to claim 1, wherein the driving device drives said feeding rotation member.

6. The sheet feeding apparatus according to claim 1, wherein said moving device moves said pad mount such that separation surface pressure in said nip area between said separation pad and said feeding rotation member is gradually increased in association with the movement toward the direction in which said nip area is gradually narrowed.

7. The sheet feeding apparatus according to claim 1, wherein said moving device moves said pad mount to return said narrowed nip area to an original area after a rear end of the sheet to be separated enters said nip area.

8. The sheet feeding apparatus according to claim 1, wherein said separation pad includes a nip forming portion which faces said feeding rotation member and a support portion which supports said nip forming portion in a bridge manner, said nip forming portion being provided on an upstream side and a downstream side in the sheet feeding direction of said nip forming portion, and a thickness of said nip forming portion on the upstream side in a sheet conveyance direction is thinner than a thickness of said nip forming portion on the downstream side.

9. The sheet feeding apparatus according to claim 1, comprising control means which controls action of said moving device.

10. An image reading apparatus having reading device which reads an image of a sheet to be read, the image reading apparatus comprising a sheet feeding apparatus according to any one of claims 1 to 9 as the sheet feeding apparatus which feeds the sheet to said reading device.

11. An image forming apparatus having recording device which records an image to a sheet to be recorded, the image forming apparatus comprising a sheet feeding apparatus according to any one of claims 1 to 9 as the sheet feeding apparatus which feeds the sheet to said recording device.

* * * * *

UNITED STATES PATENT AND TRADEMARK OFFICE

CERTIFICATE OF CORRECTION

PATENT NO. : 7,384,032 B2
APPLICATION NO. : 11/275898
DATED : June 10, 2008
INVENTOR(S) : Sata It is certified that error appears in the above-identified patent and that said Letters Patent is hereby corrected as shown below:

COLUMN 4:
Line 45, "moving" should read --a moving--.

Signed and Sealed this

Twenty-third Day of December, 2008

JON W. DUDAS
*Director of the United States Patent and Trademark Office*